US005375513A

United States Patent [19]

Michael et al.

[11] Patent Number: 5,375,513

[45] Date of Patent: Dec. 27, 1994

[54] PRESS INSTALLATION WITH SLIDES CONNECTED AT LINKING POINTS BY CONNECTING RODS TO A PRESS FRAME

[75] Inventors: Wolfgang Michael, Göppingen; Kurt Strommer, Kuchen, both of Germany

[73] Assignee: L. Schuler GmbH, Germany

[21] Appl. No.: 80,783

[22] Filed: Jun. 24, 1993

[30] Foreign Application Priority Data

Jun. 27, 1992 [DE] Germany ..... 4221147

[51] Int. Cl.[5] ..... B30B 15/28; B30B 15/14

[52] U.S. Cl. ..... 100/53; 72/26; 72/405; 72/417; 100/207; 100/257; 100/282

[58] Field of Search ..... 100/53, 207, 208, 257, 100/282; 72/26, 405, 417, 421

[56] References Cited

U.S. PATENT DOCUMENTS

| | | | |
|---|---|---|---|
| 2,947,273 | 8/1960 | Dehn et al. | 72/417 |
| 3,130,699 | 4/1964 | Ward | 72/417 X |
| 3,707,908 | 1/1973 | Merk et al. | 100/207 |
| 3,779,155 | 12/1973 | Ohno | 100/207 |
| 4,135,446 | 1/1979 | Bareis et al. | 100/257 |
| 4,166,415 | 9/1979 | Spanke et al. | 100/257 X |
| 4,461,206 | 7/1984 | Baba | 100/208 |
| 4,593,547 | 6/1986 | Heiberger | 72/26 X |
| 4,627,265 | 12/1986 | Bulso, Jr. et al. | 72/405 |
| 5,012,665 | 5/1991 | Brandstetter | 72/405 |
| 5,102,278 | 4/1992 | Herdzina, Jr. | 100/207 X |

FOREIGN PATENT DOCUMENTS

| | | | |
|---|---|---|---|
| 2839269 | 5/1979 | Germany | 72/405 |
| 61-276722 | 12/1986 | Japan | 72/405 |

*Primary Examiner*—Stephen F. Gerrity
*Attorney, Agent, or Firm*—Evenson, McKeown, Edwards & Lenahan

[57] ABSTRACT

A press installation that has working stages with a press frame having press supports, a press bed, a headpiece, and turnbuckles which rigidly connect the press supports, the press bed, and the headpiece with one another. The press installation has a slide for forming that extends along a plurality of the working stages, a transfer device that transfers workpieces between the working stages, and driving devices that drive the slide and the transfer device. Connecting rods link the slide without pressure points and therefore directly in four linking points. The centers of the two linking points respectively of one side of the slide and of two turnbuckles situated opposite one another in the press frame are arranged on a common line which is aligned horizontally and vertically with respect to a press passage. The slide is an outer slide, while inner slides are provided in the working stages, these inner slides being vertically slidably disposed via guides. At least one overload safety device is respectively arranged between each of the inner slides and the outer slide, the overload safety device including a pressure space in a pressure cylinder and a piston. The pressure space is prestressed for operation of the press installation while admitting pressure via pressure lines to the piston and thereby to the inner slide in a vertically downward direction.

5 Claims, 2 Drawing Sheets

PRESS INSTALLATION WITH SLIDES CONNECTED AT LINKING POINTS BY CONNECTING RODS TO A PRESS FRAME

BACKGROUND AND SUMMARY OF THE INVENTION

The present invention relates to a press installation that has working stages with a press frame having press supports, a press bed, a headpiece, and turnbuckles which rigidly connect the press supports, the press bed, and the headpiece with one another. The press installation has a slide for forming that extends along a plurality of the working stages, a transfer device that transfers workpieces between the working stages, and driving devices that drive the slide and the transfer device.

In such a press installation, the working of sheet metal parts (workpieces) takes place in several working steps. The necessity for reducing investment and operating costs has resulted in a combining of working steps carried out on individual presses in press trains by using compact, multistage multiframe presses.

The previous development direction of such press installations is shown in FIGS. 1A to 1F of the U.S. Pat. No. 5,012,665.

An object of the present invention is to significantly lower the investment and operating costs of such press installations. This goal can be achieved by the reduction of the number of component parts and by the taking-over (integrating) of several functions into remaining components, as in the present invention.

This and other objects are achieved by the present invention which provides a press installation that has working stages with a press frame having press supports, a press bed, a headpiece, and turnbuckles which rigidly connect the press supports, the press bed, and the headpiece with one another. The press installation has a slide for forming that extends along a plurality of the working stages, a transfer device that transfers workpieces between the working stages, and driving devices that drive the slide and the transfer device. Connecting rods link the slide without pressure points and therefore directly in four linking points. The centers of the two linking points respectively of one side of the slide and of two turnbuckles situated opposite one another in the press frame are arranged on a common line which is aligned horizontally and vertically with respect to a press passage. The slide is an outer slide, while inner slides are provided in the working stages, these inner slides being vertically slidably disposed via guides. At least one overload safety device is respectively arranged between each of the inner slides and the outer slide, the overload safety device including a pressure space in a pressure cylinder and a piston. The pressure space is prestressed for operation of the press installation while admitting pressure via pressure lines to the piston and thereby to the inner slide in a vertically downward direction.

One of the advantages of the present invention is the provision of a compact, short press installation while intermediate depositing areas are eliminated and the press driving elements are reduced.

Other objects, advantages and novel features of the present invention will become apparent from the following detailed description of the invention when considered in conjunction with the accompanying drawings.

DETAILED DESCRIPTION OF THE DRAWINGS

Figure 1:
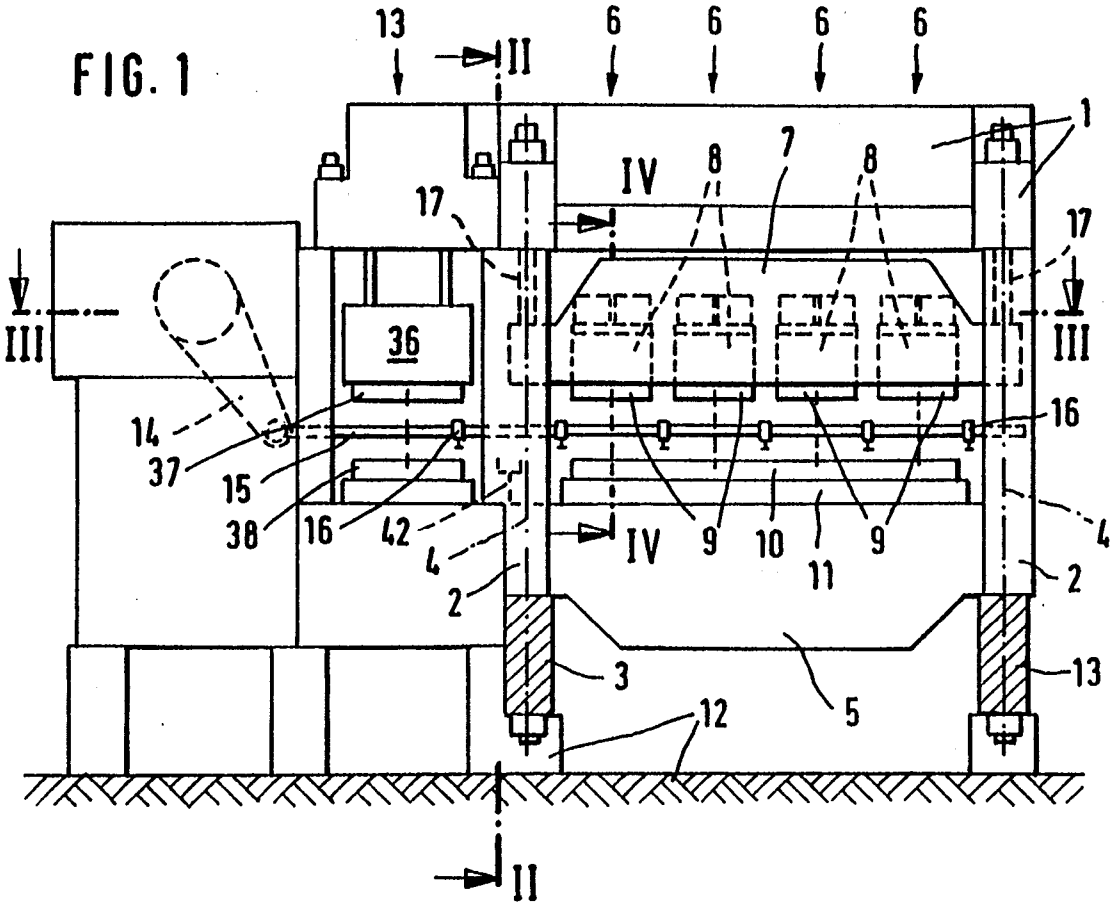
FIG. 1 is a main view of a press construction in accordance with an embodiment of the present invention.

The illustrated press installation of FIG. 1 comprises a headpiece 1 which extends along the working stages 6. The headpiece 1 is supported on press supports 2 which are set up on the foundation 12 by way of frame cross traverses 3. These structural elements of the press installation are braced by means of turnbuckles 4. A press bed 5 is placed on the frame cross traverses 3. A sliding table 11 with a tool bottom part 10 or a set of tool bottom parts is slid onto the press bed 5. In the upper area of the press installation, an outer slide 7 is disposed by guides 23 guided in corresponding guides 22 (FIG. 4) located on the press supports 2 and is lifted and lowered via connecting rods 17.

The outer slide 7 extends along several working stages 6. The drive of the slide or slides takes place via motor-driven transmissions 19, 20 in the headpiece 1 (see FIG. 2). A transfer device for the sheet metal parts, which are to be moved from working stage 13 to working stage 6, extends through the whole press installation. This transfer device comprises oscillating levers 14 which are driven, for example, in the timing of the slides/press installation, and are applied to rails 15 which carry grippers 16 or are applied directly to devices 16 which carry grippers and which may be suction bars.

Reference number 13 indicates a drawing stage which is connected in front of the working stages 6 and comprises a drawing slide 36, a tool top part 37 and a tool bottom part 38. Between the drawing stage 13 and a first working stage 6, an intermediate depositing device 42 is arranged halfway between these stages.

Figure 2:
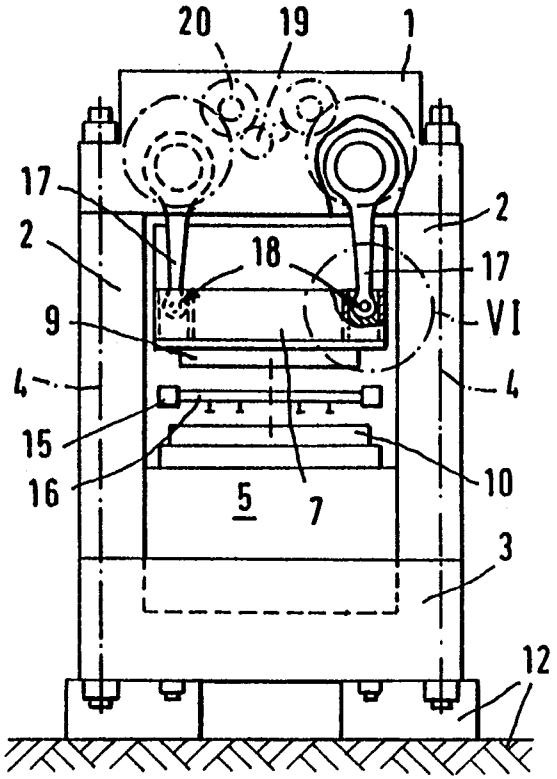
FIG. 2 is a view corresponding to the course of section II—II in FIG. 1.
Figure 6:
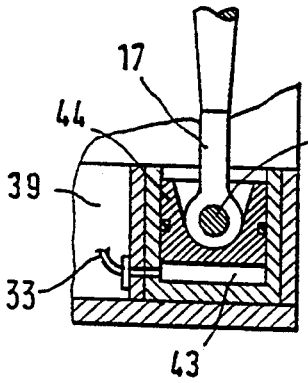
FIG. 6 is a view of a further linking arrangement of the connecting rod on the slide corresponding to the enlargement region VI in FIG. 2.

In the linking points 18 and 40, as illustrated in detail in FIGS. 2 and 6, the connecting rods 17 are applied to the outer slide 7 or the slide 39. The present invention provides two embodiments, the first embodiment relating to the direct working of the connecting rods 17 on the outer slide 7 corresponding to FIG. 2. The second embodiment according to FIG. 6 provides for each of the four linking points 40 of the connecting rods 17 on the slide, (in this embodiment reference numeral 39), a safety device in the form of an overload safety device 41. In the respective linking point 40, the connecting rods 17 are connected with a pressure piston 44. The pressure space 43 provided below the pressure piston 44 is adjusted to a defined pressure level via a pressure line 33 for the press operation.

Figure 3:
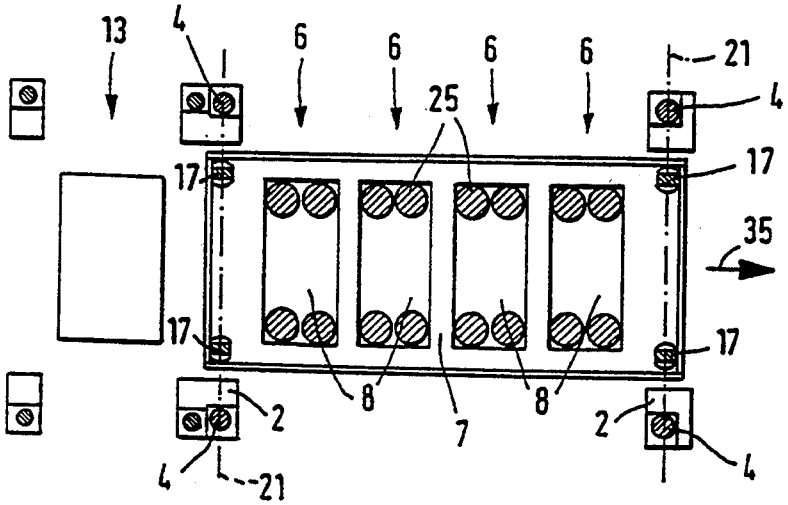
FIG. 3 is a view corresponding to the course of section III—III in FIG. 1 showing the outside and inside slides.
Figure 4:
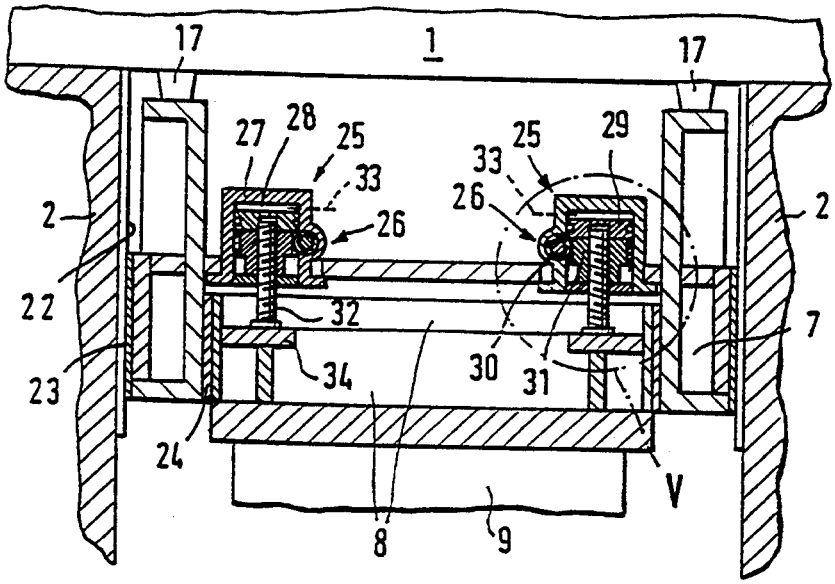
FIG. 4 is an enlarged sectional view corresponding to the course of section IV—IV in FIG. 1.

FIGS. 1, 3 and 4 show the outer slide 7 into which, in this illustrated embodiment, four inner slides 8 are inserted, corresponding to the number of working stages 6. The inner slides 8 are disposed in a liftable and lowerable manner in the outer slide 7 by means of guides 24.

Figure 5:
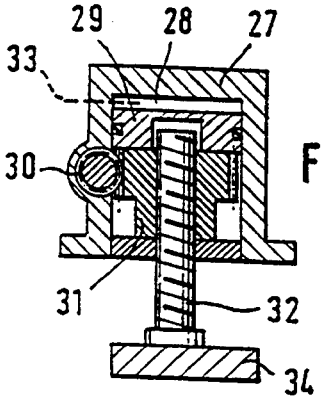
FIG. 5 is a representation of a cutout corresponding to the enlargement region V in FIG. 4.

FIG. 3 illustrates that the centers of the connecting rods 17 and the centers of the turnbuckles 4 situated on opposite sides of the press installation are arranged on a common line 21 for achieving favorable load and force application points. The line 21 is a horizontal line and extends transversely/perpendicularly to the passage direction of the press. The passage direction of the press (i.e., the transport direction of the workpieces) has the reference number 35 in FIG. 3. Corresponding to FIGS. 4 and 5, each inner slide 8 has console plates 34 on which one spindle 32 respectively is rigidly fastened which points in the upward direction. The spindle 32 interacts with a worm wheel 31, which can be rotationally driven by a motor-driven worm 30, in the manner of a nut-spindle connection, for the height adjustment of the deposited tool. The piston 29 of a pressure cylinder 27 rests on the worm wheel 31. Above the piston 29, a pressure space 28 is provided which, in the operative condition of the press installation, is acted upon by pressure via the pressure line 33.

The worm, worm wheel and spindle arrangement 30, 31, 32 permits the adjustment of the inner slides 8 in the outer slide 7. By means of these devices, a height adjustment 26 of the tools can therefore be carried out. The arrangement of the pressure cylinders 27, the pressure space 28, the piston 29 and the spindle 32 permits the securing of the working stages in the case of an overload as an overload safety device 26.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A press installation having working stages, comprising:

a press frame having press supports, a press bed, and at least one headpiece;

turnbuckles which rigidly connect the press supports, the press bed, and said at least one headpiece with one another, said turnbuckles including pairs of turnbuckles situated on opposite sides of the press frame;

at least one slide for forming that extends along a plurality of the working stages and is movably coupled to the press frame between the press supports, the at least one slide having ends;

a transfer device that transfers workpieces between the working stages;

driving devices coupled to the at least one slide and the transfer device, the driving devices driving the at least one slide and the transfer device;

connecting rods coupled between the press frame and the at least one slide such that the at least one slide is linked to the press frame without pressure points and therefore directly in four linking points, with two of the linking points being situated on opposite sides of the at least one slide at both ends of the at least one slide respectively, wherein centers of the two linking points respectively of one end of the at least one slide and of one of the pairs of turnbuckles are arranged on a common line which is aligned horizontally and vertically with respect to a press passage;

wherein the slide is an outer slide, and further comprising inner slides defining the working stages, the inner slides being vertically slidably disposed via guides;

at least one overload safety device interposed between each of the inner slides and the outer slide, the overload safety device including a pressure space in a pressure cylinder and a piston, wherein the pressure space prestressed for operation of the press installation while admitting pressure via a pressure line to the piston and thereby to the inner slide in a vertically downward direction.

2. A press installation according to claim 1, further comprising tool height adjusting devices coupled to the overload safety devices, the tool height adjusting devices respectively interacting with each of the overload safety devices between the outer slide and each of the inner slides.

3. A press installation according to claim 2, wherein in the pressure cylinder of each overload safety device a worm wheel and spindle are provided, the spindle being rigidly fastened to the outer slide., the piston acting upon the worm wheel and via this worm wheel on said spindle, and further comprising a thread-nut connection being between the spindle and the worm wheel, and a motor-driven worm coupled to the worm wheel that rotationally adjusts the worm wheel.

4. A press installation having a plurality of working stages, comprising:

a press frame having press supports, a press bed, and at least one headpiece;

turnbuckles which connect the press supports, the press bed, and the at least one headpiece with one another, said turnbuckles including pairs of turnbuckles situated on opposite sides of the press frame;

a first slide in first of the working stages, the first working stage being a drawing stage that has a drawing tool, and a single additional slide in the other working stages, the first slide and the additional slide being movably coupled to the press frame between the press supports;

a transfer device that transfers workpieces over a transfer step between the working stages;

driving devices coupled to the first slide and the additional slide and the transfer device that drive the slides and the transfer device;

wherein only the one additional slide is provided in common for all of the working stages except for the drawing stage;

connecting rods that couple the additional slide to the press frame, wherein the additional slide has corner areas that are separately linked as four linking points to the connecting rods, with each of the linking points being provided with a pressure point for protection from an overload; and an intermediate depositing area between the drawing stage and a successive working stage, wherein a distance from approximately a center of a drawing tool of the drawing stage to a center of the intermediate storage device, a distance from the center of the intermediate storage device to the successive working stage, and the distances between the additional working stages are equal and correspond to a transfer step of the transfer device.

5. A press installation according to claim 4, wherein the centers for the two linking points respectively at the corner areas of one slide end and of two turnbuckles situated on opposite sides of the press frame are arranged on a common line which is aligned horizontally and vertically with respect to a press passage.

* * * * *